United States Patent [19]

Halder et al.

[11] Patent Number: 4,845,938

[45] Date of Patent: Jul. 11, 1989

[54] MEANS FOR MOUNTING A SUCTION TUBE ON A TEXTILE MACHINE

[75] Inventors: Ernst Halder, Waschenbeuren; Friedrich Dinkelmann, Rechberghausen; Robert Buder, Memmingen, all of Fed. Rep. of Germany

[73] Assignee: Zinser Textilmaschinen GmbH, Fed. Rep. of Germany

[21] Appl. No.: 132,434

[22] Filed: Dec. 8, 1987

[30] Foreign Application Priority Data

Dec. 4, 1986 [DE] Fed. Rep. of Germany ..... 3641479

[51] Int. Cl.[4] ..... D01H 5/66; D01H 5/68

[52] U.S. Cl. ..... 57/305; 19/263; 57/304

[58] Field of Search ..... 57/300, 304, 305; 19/263

[56] References Cited

U.S. PATENT DOCUMENTS

| | | | |
|---|---|---|---|
| 2,522,250 | 9/1950 | Bechtler | 57/305 |
| 2,782,589 | 2/1957 | Furstenberg | 57/305 |
| 2,843,995 | 7/1958 | Furstenberg | 57/305 |
| 2,849,852 | 9/1958 | Jacobi et al. | 19/263 |
| 2,893,196 | 7/1959 | Struber | 19/263 X |
| 2,956,389 | 10/1960 | Berberich et al. | 19/263 |
| 3,073,105 | 1/1963 | Jacobi et al. | 57/305 |

FOREIGN PATENT DOCUMENTS

| | | |
|---|---|---|
| 1119156 | 12/1961 | Fed. Rep. of Germany . |
| 2605601 | 8/1977 | Fed. Rep. of Germany . |
| 7812638 | 8/1978 | Fed. Rep. of Germany . |
| 354700 | 7/1961 | Switzerland . |

*Primary Examiner*—John Petrakes

*Attorney, Agent, or Firm*—Shefte, Pinckney & Sawyer

[57] ABSTRACT

An arrangement for mounting a suction tube on a fly frame, roving frame, ring spinning machine or the like for collecting broken ends of yarn at the outlet rollers of the machine. The suction tube has a suction end and an opposite end connected through a flexible sealing sleeve to a collection chamber, with the sleeve permitting the suction tube to pivot between different positions. A mounting rod is secured to and extends between the stanchions of the machine frame intermediate the collection chamber and the outlet rollers, and a support arrangement is mounted on the rod and includes a retaining mechanism for positioning the suction tube and releasably retaining it in an operative position in which the suction end is proximal the outlet rollers and an inoperative position in which the suction end is spaced from the outlet rollers. In one embodiment the suction tube is pivotally mounted on one arm of the support and releasably retained in a slot in another arm of the support. In another embodiment the suction tube is fixed to the support and the support pivots on the rod, being releasably retained in operative and inoperative positions by a ball detent mechanism or by cooperating surface engagement between the support and the rod.

17 Claims, 2 Drawing Sheets

MEANS FOR MOUNTING A SUCTION TUBE ON A TEXTILE MACHINE

BACKGROUND OF THE INVENTION

The present invention relates to textile machines, and more particularly to a mounting means for a suction tube on a fly frame, roving frame, ring spinning machine or like textile machine for collecting broken ends of yarn at the outlet rollers of the machine, wherein the suction tube has a suction end disposed at the outlet rollers and an opposite end connected through a flexible sealing sleeve to a collection chamber, with the sleeve being flexible to permit the suction tube to pivot therein between an operative position in which the suction end is proximal the outlet rollers and an inoperative position in which the suction end is spaced from the outlet rollers.

Conventionally, a suction tube is generally positioned at each outlet roller of a drafting or winding system of a textile machine to draw in or collect the broken yarn ends by means of suction. The suction tube is usually mounted by a flexible sleeve to the collection chamber to permit pivoting of the tube in the flexible sleeve so that the suction end of the tube can be moved a short distance away from the vicinity of the outlet rollers of the drafting system to an inoperative position to allow access to repair the thread break or for machine maintenance, the suction tube can be retained in the operative and inoperative positions by detents arranged on the collection chamber as disclosed in German Published Patent Application No. DE-AS 1 119 165 or by detents arranged on the drafting system of the machine as disclosed in German Published Patent Application No. DE-OS 26 05 601.

Problems arise in that there are generally variations in the arrangement of the collection chamber of the textile machine and these variations adversely affect the individual suction tubes in that the suction ends of the individual tubes are spaced at varying distances from the outlet rollers of the machine independently of whether the detent for retaining the suction tube in the operative and inoperative positions is located on the collection chamber or on the machine. The suction force acting on the yarn ends by the individual suction tubes therefore varies due to the variation in distances and must be compensated by an increased suction force throughout the entire system in order to insure a minimum suction force at the ends of those tubes having suction ends located at a greater distance from the outlet rollers.

As will be apparent from the discussion to follow, the present invention overcomes the disadvantages of the prior art by providing a mounting arrangement for the suction tube which permits the tube to pivot on an axis that is fixed in relation to the machine at a spacing from the collection chamber and at a uniform spacing from the outlet rollers. Therefore, the suction ends of the tubes can all be located proximal the outlet rollers uniformly when the suction tubes are in operative positions independent of variations in the spacing between the collection chamber and the outlet rollers. The suction tubes are connected to the collection chamber by flexible sealing sleeves that permit the tubes to pivot away from the operative positions and into inoperative positions in which the suction ends are moved away from the outlet roller to allow access to repair yarn breaks or for machine maintenance.

SUMMARY OF THE INVENTION

Briefly described, the mounting means of the present invention comprises a mounting member secured to and extending from the machine frame intermediate the collection chamber and the outlet rollers and a support means mounted on the mounting member for supporting the suction tube for pivotal movement between the operative and inoperative positions and for releasably retaining the suction tube in at least one of these positions. The suction tube is pivotally connected to the support means at a pivot axis about which the suction tube pivots between the operative and inoperative positions.

In one embodiment of the present invention, the support means comprises a pair of spaced arms. The suction tube is pivotally connected to one of the arms, and the other arm is formed with a tube receiving slot permitting movement of the tube therein during pivoting of the tube between positions. The slot includes an enlarged portion to define tube retaining means in which the tube is releasably retained in one of the operative or inoperative positions. Preferably, the slot includes another enlarged portion for releasably retaining the tube in the other of the operative or inoperative positions with a narrow intermediate portion through which the tube moves from one position to the other. The tube retaining means with the two enlarged portions and the narrow intermediate portion therebetween, is bifurcated for yieldable spreading to accommodate movement of the tube between the operative and inoperative positions.

In another embodiment of the present invention, the support means is pivotally mounted on the mounting member to permit pivoting of the support means for pivoting of the suction tube between the operative and inoperative positions. Preferably, the mounting member is generally cylindrically shaped and the support means includes an opening through which the mounting member extends for support of the support means thereon and on which the support means is pivotable for movement of the suction tube between the two positions. In the preferred embodiment, detent means is formed in the mounting member and the support means for releasably retaining the support means in position for retaining the suction tube in the operative and inoperative positions with the suction tube being rigidly fixed intermediate its ends to the support means.

In another embodiment of the present invention, the suction tube is rigidly fixed intermediate its ends to the support member, and the mounting member is formed with a pair of diametrically opposed flat surfaces, preferably, a first pair of diametrically opposed flat surfaces and a second pair of diametrically opposed flat surfaces, with the second pair of flat surfaces being spaced apart substantially equal to the spacing between the surfaces of the first pair of surfaces and angularly offset with respect thereto. The support means is formed with a mounting slot through which the mounting member extends in order to mount the support means on the mounting member. The slot has opposed flat surfaces spaced apart substantially equal to the spacing between the opposed flat surfaces of the mounting member. The support means is yieldable at the slot to permit pivoting of the support means between engagement of the flat surfaces of the slot against one of the pair of flat surfaces of the mounting member for retaining the suction tube in one of the operative or inoperative positions and engagement of the flat surfaces of the slot against the other of the pairs of flat surfaces of the mounting member for retaining the suction tube in the other of the operative or inoperative positions.

In the preferred embodiment of the present invention the machine frame includes spaced stanchions and the mounting member is secured to and extends between the stanchions.

Other and further features and advantages of the present invention will be apparent from the accompanying drawings and the following detailed description of the preferred embodiment.

DESCRIPTION OF THE PREFERRED EMBODIMENTS

Figure 1:
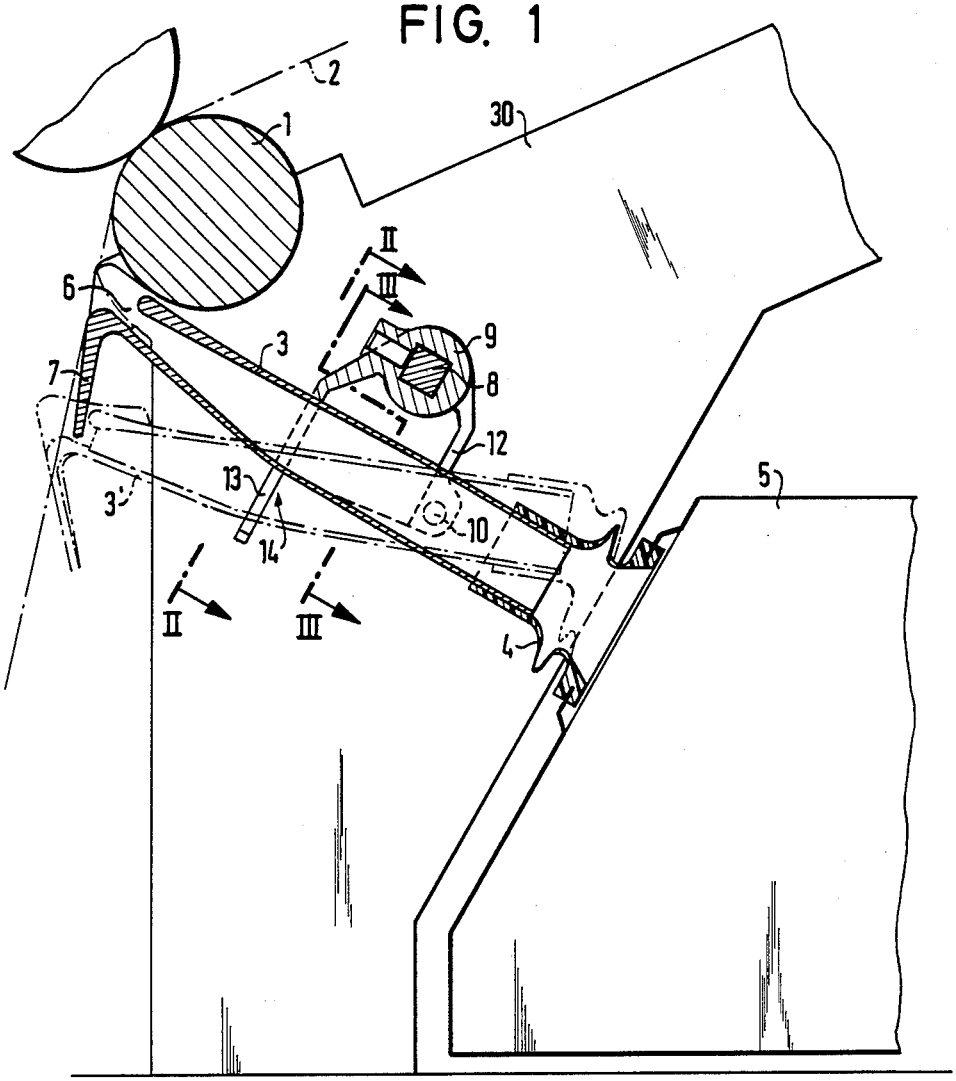
FIG. 1 is a vertical cross-sectional view of a portion of a textile machine includes the bottom roller of a pair of outlet rollers, a suction tube and a collection chamber with means for mounting the suction tube according to one of the preferred embodiments of the present invention.

Referring now in greater detail to the accompanying drawings and initially to FIG. 1, a bottom roller 1 of a pair of outlet rollers of a drafting arrangement for a fly frame or a ring spinning machine is shown. A strand of yarn 2 runs over the bottom roller 1 and past a suction end 6 of a suction tube 3 which is located below the bottom roller 1. The suction end 6 of the tube 3 projects proximal the bottom roller 1 and the yarn path being generally tangential thereto, when the suction tube 3 is in its operative position for sucking in a broken yarn end. The suction end 6 is also provided with a gripping arrangement 7 integrally attached to the side of the suction tube 3 proximal the opening of the suction end 6. The gripping arrangement 7 is angled downwardly and permits movement of the suction tube 3 between its operative position (solid lines in FIG. 1) and an inoperative position (dot-dash lines in FIG. 1) in which the suction end 6 is spaced from the bottom roller 1.

The end of the suction tube 3 opposite the suction end 6 is connected through a flexible sealing sleeve 4 to a collection chamber 5. The flexible sealing sleeve 4 permits the suction tube 3 to move between its operative and inoperative positions.

A mounting means for the suction tube 3 is located intermediate the ends of the tube 3 and includes a mounting member 8 which is attached to the frame of the machine. Mounted on the mounting member 8 is support means 9 for each individual suction tube 3. Each support means 9 has two parallel arms, a suction tube pivoting arm 12 and a suction tube retaining arm 13, extending parallel at a spacing from one another. The pivoting arm 12 permits the suction tube 3 to pivot about an axis between the operative and inoperative positions, and the retaining arm 13 allows the suction tube 3 to be releasably retained in either of these positions.

Figure 3:
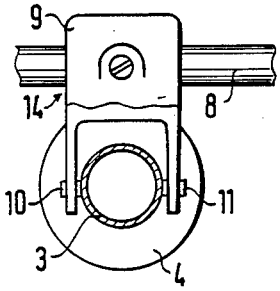
FIG. 3 is an enlarged vertical cross-sectional view of a portion of the mounting means of FIG. 1 as viewed along lines III—III thereof.

Referring now to FIGS. 1 and 3, the pivoting arm 12 is substantially fork-shaped with the two prongs of the fork extending on opposite sides of the tube 3. The suction tube 3 includes a pair of diametrically opposite bushings 10,11 intermediate the suction end 6 and the flexible sealing sleeve 4, and the two prongs of the pivoting arm 12 each include an opening therein for receipt of the bushings 10,11. The bushings 10,11 rotate within the openings to permit the suction tube 3 to pivot about an axis defined by the bushings 10,11 between the operative and inoperative positions.

Figure 2:
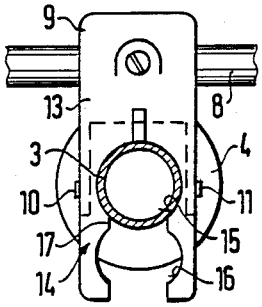
FIG. 2 is an enlarged vertical cross-sectional view of a portion of the mounting means of FIG. 1 as viewed along lines II—II thereof.

Referring to FIG. 2, retaining arm 13 includes retaining means 14 defined by a tube receiving slot having two enlarged portions 15,16 shaped substantially correspondingly to the shape of the exterior of the suction tube 3 for engagement therewith for releasably retaining the suction tube 3 in its operative and inoperative positions. The two enlarged portions 15,16 are adjacent each other in line with the direction of movement of the suction tube 3 when the tube 3 is pivoted between its operative and inoperative positions. Another narrow portion 17 of the slot lies intermediate the two enlarged portions 15,16 with the retaining arm 13 being yieldable at the slot to permit movement of the tube 3 through the narrow portion 17 from one position to the other..

Referring again to FIGS. 1 and 2, the suction tube 3 is resiliently retained in its operating position when the suction tube 3 is engaged in the enlarged portion 15 of the slot of the retaining arm 13 which is closest to the mounting member 8 with the suction end 6 of the tube 3 proximal the bottom side of the bottom roller 1 and immediately adjacent the path of travel of the yarn strand 2 as depicted in solid lines in FIG. 1. When it becomes necessary to move the suction tube 3 from its operative position to its releasably retained inoperative position for access to the roller 1 for repair, repairing yarn breaks or for maintenance, a machine operator merely grasps the gripping arrangement 7 and pulls downwardly to pivot the tube 3 about the pivot axis defined by the bushings 10,11, and the support means 9 will yield permitting the tube 3 to slip through the intermediate portion 17 of the slot into the enlarged portion 16 farthest from the mounting member 8, where the tube 3 is releasably retained in its inoperative position 3' with the suction end 6 spaced from the bottom roller 1 of the outlet rollers as depicted by the dot-dashed lines in FIG. 1. The sealing sleeve 4, as previously mentioned, is flexible to permit the suction tube 3 to pivot as described.

From the previous description and FIG. 1, it should be understood that the support means 9 and the axis about which the suction tubes 3 are pivotally mounted are associated through the mounting member 8 with the drafting system so that a close tolerance can be maintained with respect to the bottom roller 1 and wide variations in location of the collection chamber 5 have no appreciable effect on the location of the suction ends 6 of the tubes 3 at the bottom roller 1. Thus a uniform suction force at the suction ends 6 of the tube 3 is applied without having to increase the suction through the collection chamber 5 to accommodate variations that would be necessary were the suction tubes 3 fixed to the collection chamber 5.

The support means 9 is rigidly secured to the mounting member 8 in the embodiment of the present invention shown in FIGS. 2 and 3.

Figure 4:
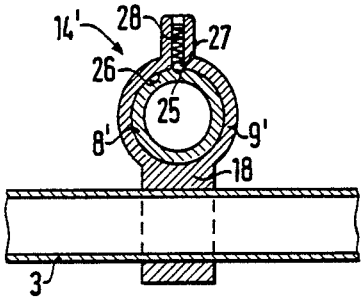
FIG. 4 is an enlarged vertical cross-sectional view of a portion of the mounting means of the present invention according to another embodiment of the present invention.
Figure 5:
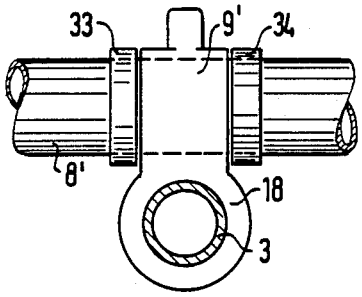
FIG. 5 is an enlarged vertical cross-sectional view of the mounting means of FIG. 4 as viewed at a right angle thereto.

Referring now to FIGS. 4 and 5, another embodiment of the present invention is shown in which the mounting member 8' is generally cylindrically shaped and the support means 9' includes an opening through which the mounting member 8' extends for support of the support means 9' thereon. The support means 9' includes a bushing 18 which is pivotable on the mounting member 8', and the suction tube 3 is rigidly secured to the support means 9', whereby the suction tube 3 will pivot between its operative and inoperative positions.

Retaining means in the form of the detent mechanism 14' is formed in the mounting member 8' and the support means 9' for releasably retaining the support means in positions for retaining the suction tube 3 in the operative and inoperative positions. The detent mechanism 14' includes two recesses 25,26 which are formed in the outside cylindrical surface of the mounting member 8' and are spaced circumferentially from one another and by a ball 27 biased by a spring 28 which is held in position by the supporting means 9', whereby the ball 27 will respectively engage each of the recesses 25,26 as the suction tube 3 is pivoted between its operative and inoperative positions for releasably retaining the suction tube 3' in these positions.

As seen in FIG. 5, two retainer rings 33,34 are provided for properly positioning and retaining the support means 9' on the mounting member 8' with the suction end 6 of the tube 3 in proper lateral position, proximal the bottom roller 1. The retainer rings 33,34 are fastened to the mounting member 8' by fastener means (not shown) for securing the supporting means 9' in its proper position on the mounting member 8'.

Figure 6:
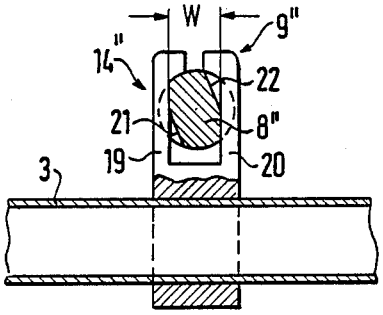
FIG. 6 is an enlarged vertical cross-sectional view of a portion of the mounting means of the present invention according to a further embodiment of the present invention.
Figure 7:
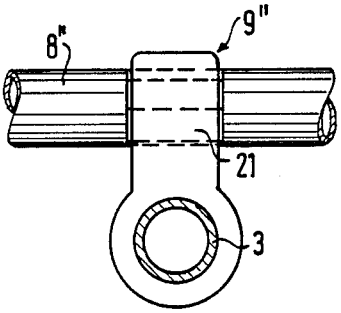
FIG. 7 is an enlarged vertical cross-sectional view of the mounting means of FIG. 6 as viewed at a right angle thereto.

A third embodiment of the present invention is shown in FIGS. 6 and 7. In this embodiment the suction tube 3 is rigidly fixed intermediate its ends to the support means 9'' and retaining means 14'' is provided which incorporates a mounting member 8'' which is formed with a first pair of diametrically opposed flat surfaces 23,25 and a second pair of diametrically opposed flat surfaces 21,22, with the surfaces 21,22 of the second pair being spaced apart a distance substantially equal to the spacing W between the surfaces of the first pair and angularly offset with respect thereto. The support means 9'' is formed with a mounting slot having opposed flat surfaces which are spaced apart substantially equivalent to the spacing W between the opposed pairs of flat surfaces 21,22; 23,25 of the mounting member 8''. The support means 9'' is yieldable at the slot to permit pivoting of the support means 9'' between engagement of the flat surfaces 19,20 of the slot against one of the pairs 23,25 of flat surfaces of the mounting member 8'' for retaining the suction tube 3 in one of its operative and inoperative positions and engagement of the flat surfaces 19,20 of the slot against the other of the pairs 21,22 of mounting member flat surfaces for retaining the suction tube 3 in the other of its positions. Since the spacing W between the pairs of flat surfaces of the mounting member 8'' is substantially smaller at the portions of the mounting member 8'' where the support means 9'' is mounted on the mounting member 8'' than the adjacent portions of the mounting member 8'', the support means 9'' is thereby retained in proper lateral position on the mounting member 8'' with the suction end 6 of the tube 3 in proper lateral position, proximal the bottom roller 1.

Figure 8:
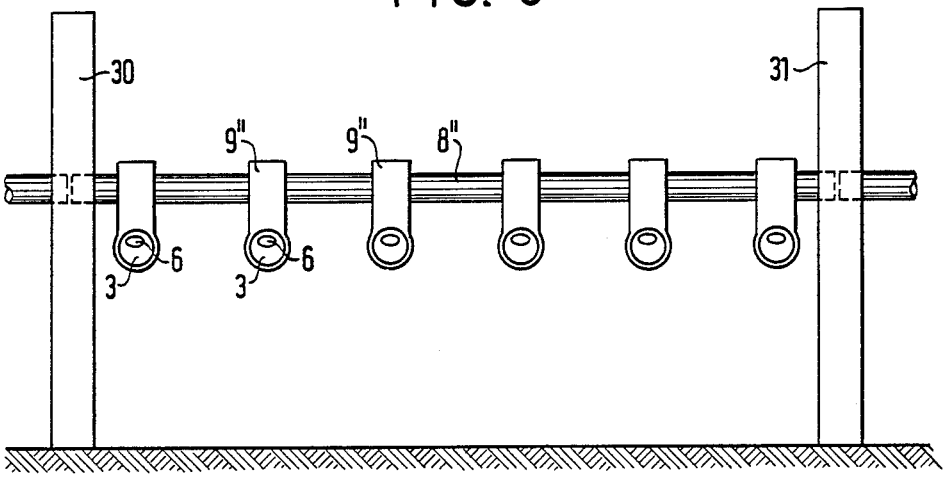
FIG. 8 is a front elevational view of the stanchions of a machine frame with a mounting member secured therebetween and support means mounted on the mounting member according to the preferred embodiment of the present invention.

Referring now to FIG. 8, in the preferred embodiments of the present invention, the machine frame includes spaced stanchions 30,31 and the mounting member 8,8',8'' is in the form of a rod secured to and extending between the stanchions 30,31. A plurality of support means 9,9',9'' with retaining means 14,14',14'' are then mounted on the mounting member in proper position for positioning the suction ends 6 of the individual suction tubes 3 proximal the bottom roller 1 of the outlet rollers for collecting broken ends of yarn 2.

It will therefore be apparent to those skilled in the art that the present invention overcomes many of the shortcomings of the prior art. Moreover, the present invention permits a machine operator to easily pivot an individual suction tube 3 from a releasably retained operative position as previously described to a releasably retained inoperative position where the outlet rollers of the machine are individually exposed to allow access for repairing yarn breaks and for maintenance.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. Means for mounting a suction tube on a fly frame, roving frame, ring spinning machine or like textile machine for collecting broken ends of yarn at the outlet rollers of the machine, wherein the textile machine includes a machine frame and outlet rollers, a collection chamber is disposed for collecting broken ends of yarn, a flexible sealing sleeve is provided connecting the suction tube to the collection chamber, the suction tube has a suction end disposed at the outlet rollers and an opposite end connected through the flexible sealing sleeve to the collection chamber, with the sleeve being flexible to permit the suction tube to pivot between an operative position in which the suction end is proximal the outlet rollers and an inoperative position in which the suction end is spaced from said outlet rollers, said mounting means comprising:

a mounting member secured to and extending from said machine frame intermediate said collection chamber and said outlet rollers, and support means mounted on said mounting member for supporting the suction tube for pivotal movement at said mounting member between said operative and inoperative positions and for releasably retaining the suction tube in at least one of said positions.

2. Mounting means according to claim 1 and characterized further in that said suction tube is pivotally connected to said support means at a pivot axis about which said suction tube pivots between said operative and inoperative positions.

3. Mounting means according to claim 1 and characterized further in that said support means comprises a pair of spaced arms, the suction tube being pivotally connected to one of said rams, and the other of said arms including means for retaining the suction tube in at least on of said positions.

4. Mounting means according to claim 3 and characterized further in that said other arm is formed with a tube receiving slot permitting movement of said tube therein during pivoting of the tube, said slot having an enlarged portion in which the tube is releasably retained in one of said positions.

5. Mounting means according to claim 4 and characterized further in that said other arm is formed with another enlarged portion for releasably retaining the tube in the other of said positions with a narrow intermediate portion through which the tube moves from one to the other of said positions.

6. Mounting means according to claims 4 or 5 and characterized further in that said tube retaining means is yieldable to permit movement of the tube between said positions.

7. Mounting means according to claim 6 and characterized further in that said tube retaining means is bifurcated for yieldable spreading to accommodate movement of the tube between said positions.

8. Mounting means according to claim 3 and characterized further in that said arms are integrally formed and fixed to said mounting member.

9. Mounting means according to claim 1 and characterized further in that said support means is pivotally mounted on said mounting member to permit pivoting of said support means for pivoting of the suction tube between said positions.

10. Mounting means according to claim 9 and characterized further in that said mounting member is generally cylindrically shaped and said support means includes an opening through which said mounting member extends for support of said support means thereon, and said support means is pivotable on said mounting member for movement of the suction tube between said operative and inoperative positions.

11. Mounting means according to claim 10 and characterized further by detent formed in said mounting member and said support means for releasably retaining said support means in position for retaining the suction tube in one of said operative and inoperative positions.

12. Mounting means according to claim 10 and characterized further by detent means formed in said mounting member and said support means for releasably retaining said support means in positions for retaining the suction tube in said operative and said inoperative positions.

13. Mounting means according to claims 10, 11 or 12 and characterized further in that the suction tube is rigidly fixed intermediate its ends to said support means.

14. Mounting means according to claim 1 and characterized further in that said mounting member is formed with a pair of diametrically opposed flat surfaces and said support means is formed with a mounting slot through which said mounting member extends to mount said support means on said mounting member, said slot having opposed flat surfaces spaced apart substantially equivalent to the spacing between the opposed flat surfaces of said mounting member, said support means being yieldable at said slot to permit pivoting of said support means into and out of engagement of the flat surfaces of the support means with the flat surfaces of said mounting member for retaining the suction tube in one of said positions.

15. Mounting means according to claim 1 and characterized further in that said mounting member is formed with a first pair of diametrically opposed flat surfaces and a second pair of diametrically opposed flat surfaces spaced apart substantially equal to the spacing between the surfaces of said first pair of surfaces and angularly offset with respect thereto, and said support means is formed with a mounting slot through which said mounting member extends to mount said support means on said mounting member, said slot having opposed flat surfaces spaced apart substantially equivalent to the spacing between the opposed flat surfaces of said mounting member, said support means being yieldable at said slot to permit pivoting of said support means between engagement of the flat surfaces of the slot against one of said pairs of mounting member flat surfaces for retaining the suction tube in one of said positions and engagement of the flat surfaces of the slot against the other of said pairs of mounting member flat surfaces for retaining the suction tube in the other of said positions.

16. Mounting means according to claims 14 or 15 and characterized further in that the suction tube is rigidly fixed intermediate its ends to said support member.

17. Mounting means according to claims 1, 2, 3, 4, 9, 10, 14 or 15 wherein said machine frame includes spaced stanchions, said mounting means being characterized further in that said mounting member is secured to and extends between said stanchions.

* * * * *